United States Patent [19]

Boehringer et al.

[11] Patent Number: 4,986,175

[45] Date of Patent: Jan. 22, 1991

[54] INK STAMP APPARATUS AND KIT

[75] Inventors: John R. Boehringer, Wynnewood; John Aff, Schwenksville, both of Pa.

[73] Assignee: Boehringer Laboratories, Norristown, Pa.

[21] Appl. No.: 655,512

[22] Filed: Sep. 28, 1984

[51] Int. Cl.[5] ..... B41K 1/02; B41K 1/32

[52] U.S. Cl. ..... 101/125; 101/327; 101/405; 206/232

[58] Field of Search ..... 101/379, 368, 327, 405, 101/406, 333, 128.21, 125; 206/232

[56] References Cited

U.S. PATENT DOCUMENTS

| | | | |
|---|---|---|---|
| D. 280,733 | 9/1985 | Fujikura . | |
| 108,351 | 10/1870 | Grosskopf | 101/368 |
| 396,233 | 1/1889 | Reynolds | 101/333 |
| 1,230,783 | 6/1917 | Rice | 101/125 |
| 2,034,191 | 3/1936 | Innes | 101/125 |
| 2,177,768 | 10/1939 | Carscallen | 101/128.21 |
| 2,415,704 | 2/1947 | O'Gorman | 101/125 |
| 2,777,824 | 1/1957 | Leeds | 101/327 |
| 2,783,711 | 3/1957 | Vance | 101/333 |
| 2,966,116 | 12/1960 | Harris et al. | 101/368 |
| 3,282,209 | 11/1966 | Muskin . | |
| 3,380,380 | 4/1968 | Funahashi | 101/379 |
| 3,438,716 | 4/1969 | Peters | 101/333 X |
| 3,464,352 | 9/1969 | Schilling | 101/327 |
| 3,468,252 | 9/1969 | Lemelson | 101/379 |
| 3,572,243 | 3/1971 | Gronau | 101/125 |
| 3,661,078 | 5/1972 | Hammel | 101/125 |
| 3,886,863 | 6/1975 | Carabott | 101/125 |
| 4,441,422 | 4/1984 | Dreeben | 101/125 |

FOREIGN PATENT DOCUMENTS

| | | | |
|---|---|---|---|
| 501729 | 7/1930 | Fed. Rep. of Germany | 101/368 |
| 1191391 | 4/1965 | Fed. Rep. of Germany | 101/368 |
| 304745 | 1/1955 | Switzerland | 101/405 |

OTHER PUBLICATIONS

Faymus Pre-Inked Color Stamp Catalog, (#169-ES copyright 1967), p. 2.

*Primary Examiner*—Clifford D. Crowder
*Attorney, Agent, or Firm*—Paul & Paul

[57] ABSTRACT

A stamp is provided, preferably of the permanent ink pad type, for stamping ink or the like through a stencil, onto a surface to which selected indicia or the like is to be stamped. The stencils are removable and replaceable, and are releasably carried by the stamp, preferably by means of a band, and the stamp is provided with standoffs, that allow for accurate placement of a stamp on a surface that is desired, for proper orientation and location of the indicia that is to be stamped, prior to making ink contact with the surface. The standoffs are resiliently compressible. A kit comprising a stensil and a stamp is provided, as is a package comprising a container, a stamp, and preferably one or more stencils. The ink pad is preferably constructed of a micro reticulated plastic resin, with a higher density ink-metering portion at the stamping surface, and a lower density high-ink-retention, porous portion thereabove, for facilitating essentially permanent retention of ink therein for the life of the stamp.

6 Claims, 2 Drawing Sheets

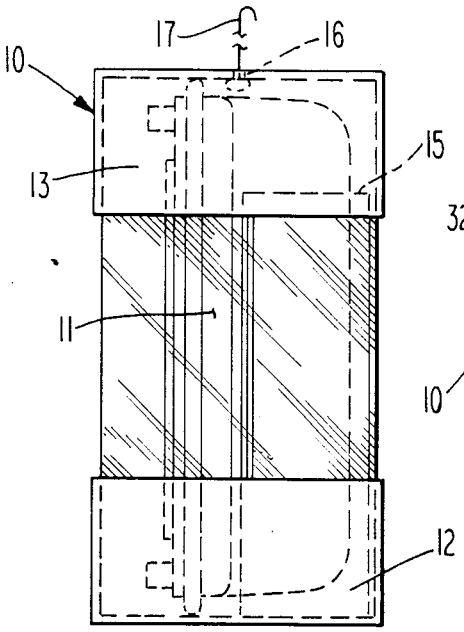
Fig. 1
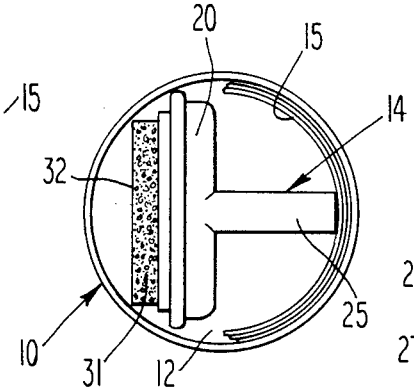
Fig. 2
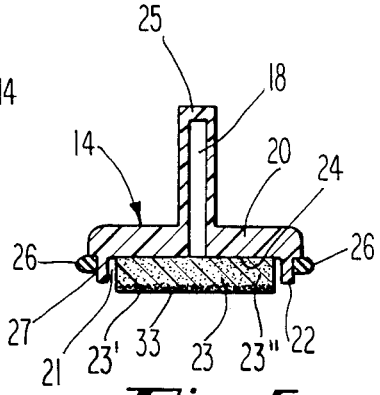
Fig. 5
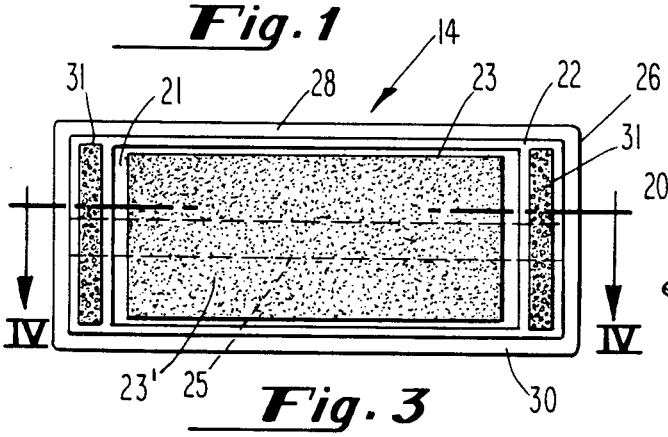
Fig. 3
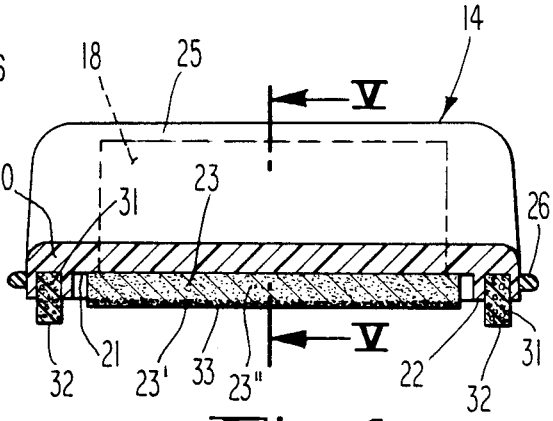
Fig. 4
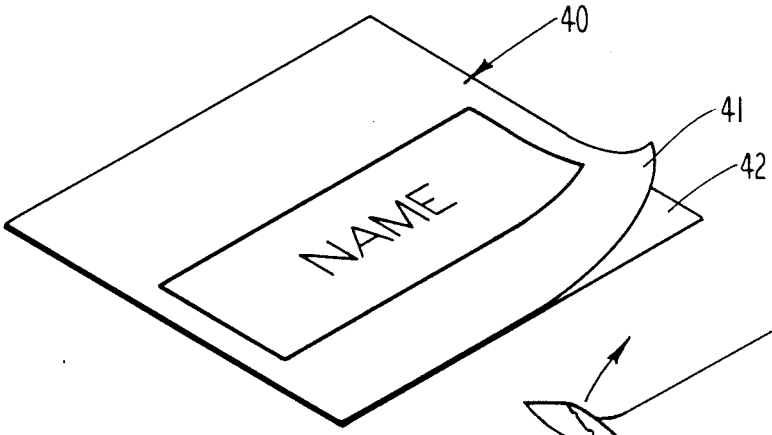
Fig. 6a
Fig. 6b
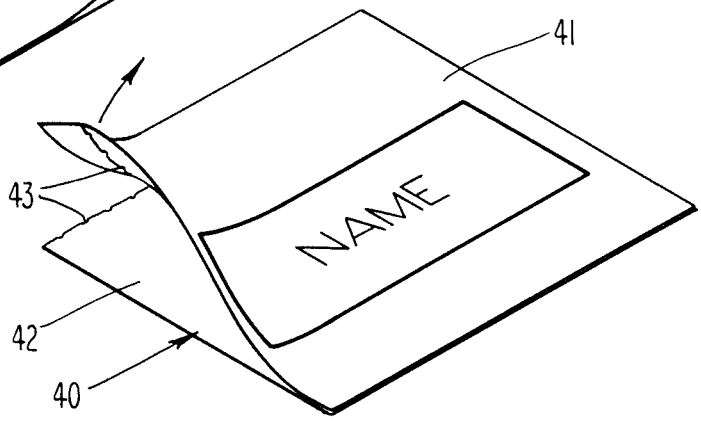

INK STAMP APPARATUS AND KIT

BACKGROUND OF THE INVENTION

It is known in the art to use ink stamps. It is also known to use stencils in front of an ink pad, for effecting the stamping of ink from the pad through a stencil. It is likewise known in the art of mimeographing, to use a reservoir of ink operating through a stencil. It is further known, in the stamping art, to use a pad that is constructed of a micro reticulated structure, generally of the plastic resin type.

Where inexpensive stamping operations are desired, it has become commonplace, such as in various business organizations, for example in mailrooms, to utilize a number of separately constructed stamps, each with its own indicia or message thereon, such as "first class", "special delivery", "rush ", etc. In other operations that are not mailroom operations, similar techniques are employed for stamping other types of indicia on desired surfaces. Generally, where inexpensive stamps are used, such as in operations of these types, each stamp has its own permanently-applied message, such that, when a number of different messages or indicia are to be used, that same number of stamps are necessary. Generally, those stamps require the user to first strike an ink pad, prior to applying the stamp to the surface to be stamped, although in some instances the stamps are each provided with their own source of ink.

THE PRESENT INVENTION

The present invention is directed to providing a novel stamp, that affords the facility for the ready replacement of any one of a number of selected stencils thereon, each with its own message, whereby a library of stencils is readily at hand, for rapid placement onto the stamp. The present invention also provides a stamp constructed with essentially a permanent application of ink, so that it does not require re-inking of the pad. The stamp for the present invention is also embodied in a kit form with one or more stencils, and preferably is sold as a unit, comprising a package that includes a container, a preferably preinked, permanently inked stamp, and one or more stencils. The stencils are preferably of the multiple sheet type, allowing handling, as for example, in a typewriter or the like, or by hand, for applying a desired message or indicia to the stamp. Particularly novel features reside in the construction of the stamp, such as a band for attachment of a stencil thereto, and resilient standoffs for proper placement of the message or indicia relative to the surface to be stamped, prior to marking the surface.

Accordingly, it is a primary object of the present invention to provide a novel stamp.

It is a further object of this invention to provide a novel kit, comprising a stamp and one or more stencils.

It is another object of this invention to provide a novel package comprising a container, a stamp and one or more stencils.

Other objects of the invention will be readily apparent to those skilled in the art from a reading of the following brief description of the drawing figures, detailed descriptions of the preferred embodiments, and the appended claims.

BRIEF DESCRIPTIONS OF THE DRAWING FIGURES

FIG. 1 is a side view of a package in accordance with this invention, comprising a sleeve-like container, end caps on ends of the container, and a stamp and stencil means, therein.

FIG. 2 is a top end view of the package of FIG. 1, illustrating how the package would look with the upper end cap removed.

FIG. 3 is a bottom view of the stamp in accordance with this invention.

FIG. 4 is a longitudinal sectional view taken through the stamp of FIG. 3, generally along the line IV—IV of FIG. 3.

FIG. 5 is a vertical sectional view taken through the stamp of FIG. 4, generally along the line V—V of FIG. 4.

FIG. 6*a* is a top perspective view of a stencil member that comprises an upper stencil sheet and a lower backing sheet, in accordance with this invention.

FIG. 6*b* is a top perspective view similar to that of FIG. 6*a* but wherein the top sheet is shown being disconnected from the bottom sheet for use.

Figure 7:
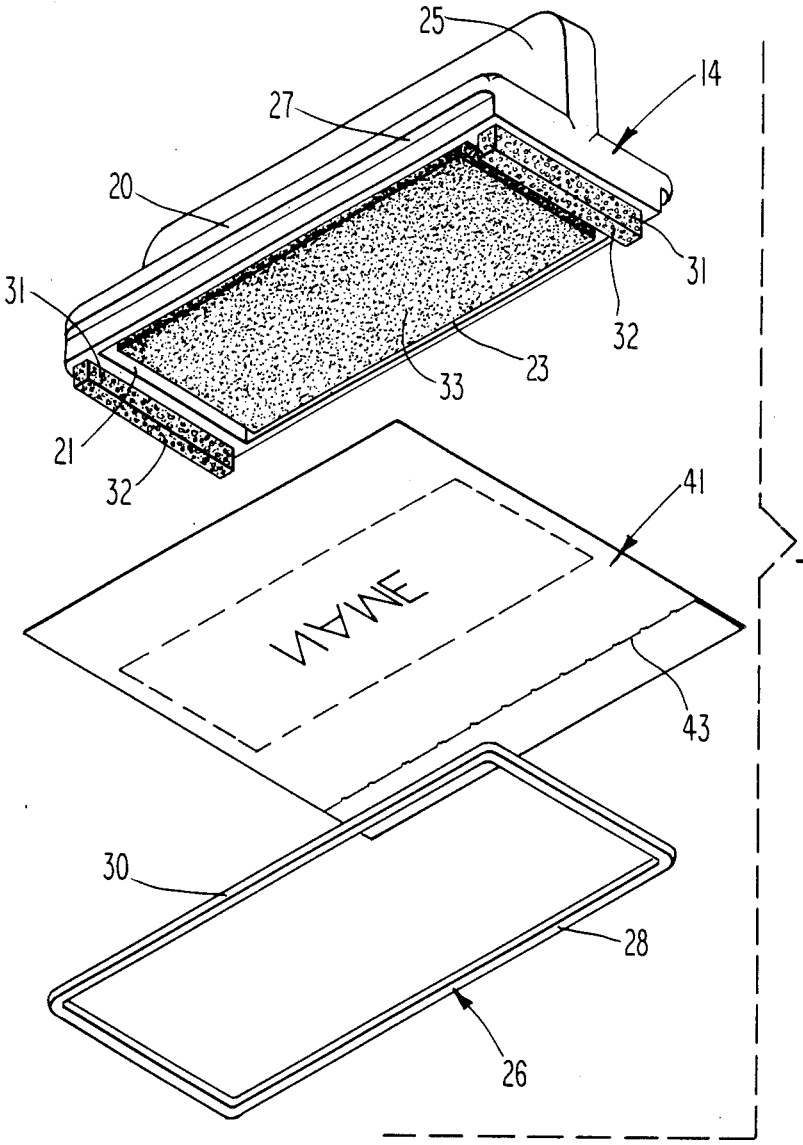

FIG. 7 is an exploded view, in perspective, showing a stencil sheet, a stamp, and a band for applying the stencil sheet to the stamp.

Figure 8:
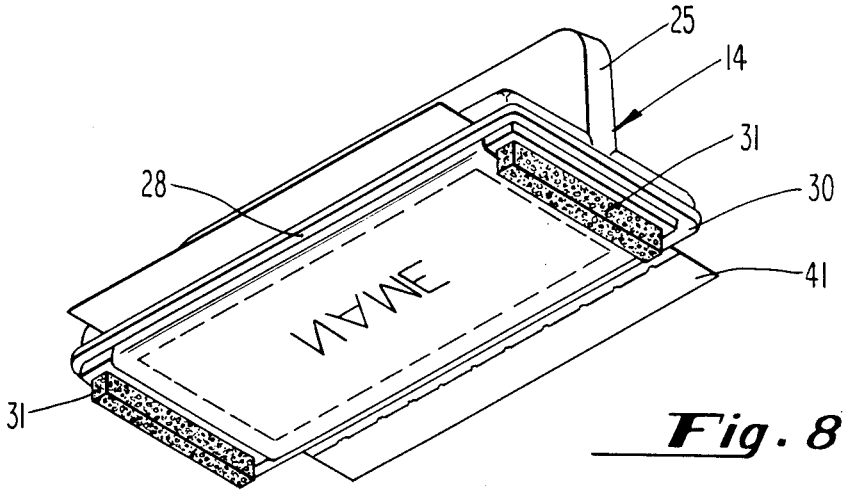

FIG. 8 is a bottom view of the kit formed after the stamp, stencil sheet, and band of FIG. 7 are applied, with FIG. 8 illustrating the kit combination in bottom perspective.

DETAILED DESCRIPTION OF THE PREFERRED EMBODIMENTS

Referring now to the drawings in detail, reference is first made to FIG. 1, wherein the package is generally designated by the numeral 10, as comprising a preferably transparent plastic sleeve 11 having preferably opaque end caps 12 and 13, at opposite ends thereof, comprising closures for opposite ends of the sleeve 11.

A stamp 14 is shown (FIGS. 1 and 2) disposed inside the sleeve 11, as are a plurality of stencil members 15. As viewed in FIG. 2, it will be noted that the stamp 14 is shown in rather snug, fitted relation within the sleeve 11, with portions of the stamp effectively touching the inner walls of the sleeve, and preferably retaining the stencil members 15 in secure position between the inner wall of the sleeve and a portion of the stamp 14. This serves to prevent rattling during transport, and to keep ink pad portions of the stamp away from undesired contact with the inner wall portions of the sleeve.

It will also be noted that one of the end caps 13, preferably has an opening 16 therein, in which there is secured a suitable hanger 17, for hanging the package 10 from a suitable carrier, for displaying the same for sales purposes.

With particular reference to FIGS. 3 through 5, it will be noted that the stamp 14 is provided with a generally rectangular, although oblong base 20, that has a preferably rectangular recess 21 in a lower face 22 of the base 20. This recess 21 accommodates a preferably rectangular pad for holding ink or the like therein, with the pad 23 being suitably adhered to cavity surface 24, by suitable adhesives or the like (not shown). An ink well 18 is provided in communication with recess 21 for storing sufficient ink therein to maintain the pad 23 in ready inked condition.

The pad 23 is constructed of two portions; an upper portion 23'' as illustrated in FIGS. 4 and 5, which is a foam of higher void volume with a higher capacity for ink storage, which is more porous, and a lower portion 23' as illustrated in FIGS. 4 and 5 that is of higher density, but which has a lower capacity for ink storage, because it is less porous. The purpose for this is to have a principal pad portion of high-storage volume, but to avoid laying down a very wet ink impression. To this end, the higher density portion 23' at the lower surface that would contact the paper or other surface being inked, would be of sufficient density to provide a metering function, metering the amount of ink that will be laid down on the surface to which it is applied. The pad can thus be constructed either as a variable density foam, or as a lamination of foam components of different densities, so long as the denser portion is nearest the surface of the pad that would be applied to the surface being inked. Typical constructions of the foam portions, would be a foam portion 23 that is about 78 percent void volume, to facilitate storage of the ink, and a lower portion 23' that is about 72 percent void volume (or higher density), to provide the metering function. Also, the more porous component 23'' will generally be several times the thickness of the metering component 23', such as approximately four times the thickness, to achieve the desired storage with proper metering.

At the upper end of the stamp 20, projecting away from the face 22, is a handle portion 25, for grasping in a conventional manner, upon use. The stamp 20 is preferably to be constructed of an inexpensive plastic material.

A band 26, of rectangular configuration is provided in friction-fit relation to the periphery of the base 20, in a recess 27 thereof, with the two longest legs 28 and 30 of the band, being rather resiliently moveable away from the adjacent portions of the base 20, to allow for receipt of stencil sheet portions therebetween, for securing a stencil sheet against the outer surface of the pad 23.

A pair of preferably foam plastic standoffs 31 are carried in suitable recesses in the face 22 of the base 20, being suitably secured therein, as by means of adhesives (not shown) or the like. The standoffs 31 are resilient, and have their lower ends 32 as illustrated in FIG. 4, generally projecting away from the face 22, a greater amount than does the face 33 of the pad 23. This enables the placement of an inked stamp, with or without a stencil applied over the face 33 of the pad, onto a generally flat surface, without creating a mark by the stamp on that surface, until pressure is applied by the user onto the handle 25, at which point the resilient standoffs 31 partially collapse until the stamp surface 33, or stencil, is brought into contact with the surface that is to be stamped. The standoffs are constructed of a foam material that has essentially immediate recovery, to rapidly assume their non-compressed condition to again function as standoffs.

With reference to FIGS. 6*a* and 6*b*, it will be seen that a stencil member 40 is provided, with an upper stencil sheet 41 and a lower backing sheet 42. The stencil sheet 41 will normally be constructed of a thin material that allows for ready breakthrough of the material, upon striking the same with a typewriter or upon pressing upon the same with a ballpoint pen, while suitable indicia, such as for example the word "NAME" is applied. Then, upon separation of sheets 41 and 42, along a preferably preperforated tearline 43, the stencil sheet 41 may be applied, as illustrated in FIG. 7, to the stamp 14, by application of the band 26 thereover, to yield a kit or combination as shown in FIG. 8, with opposite ends of the stencil sheet 41 in gripped-engagement between the longer legs 28 and 30 of the band, holding the stencil sheet 41 therebetween, between standoffs 31, such that the stamp is ready for use in order to apply the indicia thereon, to a desired surface.

It will be understood that various modifications may be made in the details of construction in accordance with this invention, but that the ink pad 23 will preferably be of the type adapted to take a permanent ink. For example, the ink pad may be constructed, if desired, of a material as is disclosed in U.S. Pat. No. 2,777,824. The pad may be a micro reticulated plastic resin of the open pore type; it may be of a flexible compressed urethane foam, such as polyester polyurethane. Also, various types of permanent inks may be utilized. It will further be understood that other configurations for the stamp may be utilized, rather than the oblong rectangular configuration illustrated, for example, in FIG. 3. For example, square configurations, round configurations, etc., may all be utilized, within the spirit and scope of the invention as defined in the appended claims.

What is claimed is:

1. A stamp for inks and the like, comprising a base having a cavity in a face thereof; a pad for receiving ink or the like disposed in said cavity and protruding from said face a first predetermined amount; a handle extending outwardly from said base in the direction generally opposite to said face; resilient, integral standoff means having an upper end disposed against said base and protruding from said face a second predetermined amount greater than said first predetermined amount and being resiliently collapsible towards said face upon application of force to said handle; including therewith a generally cylindrical sleeve, with the stamp being generally snugly disposed in the sleeve against inner wall portions of the sleeve and comprising means whereby the pad is maintained out of contact with the inner wall of the sleeve; and wherein at least one stencil means is disposed within the sleeve.

2. A stamp for inks and the like, comprising a base having a cavity in the face thereof; a pad for receiving ink or the like disposed in said cavity and protruding from said face a first predetermined amount; a handle extending outwardly from said base in a direction generally opposite to said face; securement means carried by said base for securing a stencil thereto, wherein said securement means comprises a band removably disposed around said base; and including therewith a generally cylindrical sleeve, with the stamp being generally snugly disposed in the sleeve against inner wall portions of the sleeve and comprising means whereby the pad is maintained out of contact with the inner wall of the sleeve.

3. The stamp of claim 2, wherein at least one stencil means is disposed within the sleeve.

4. The stamp as in any of claim 1 or 3, wherein said stencil means comprises a stencil sheet and a removable carrier sheet connected thereto.

5. The stamp of claim 2, wherein a removable end cap is provided on at least one end of the sleeve.

6. The stamp of claim 5, including hanger means carried by said end cap.

* * * * *